US005371663A

United States Patent [19]

Chuang

[11] Patent Number: 5,371,663

[45] Date of Patent: Dec. 6, 1994

[54] STAGE SPOTLIGHT COLOR MEDIUM STRUCTURE

[76] Inventor: Tsung-Jen Chuang, 3F, No. 6, Alley 157, Lane 189, Sec. 3, Kangning Road, Taipei, Taiwan, Prov. of China

[21] Appl. No.: 65,801

[22] Filed: May 21, 1993

[51] Int. Cl.[5] ..... F21V 17/00

[52] U.S. Cl. ..... 362/280; 362/288; 362/278; 362/398; 362/293; 362/455

[58] Field of Search ..... 362/280, 288, 278, 277, 362/283, 398, 293, 281, 455; 359/892, 903

[56] References Cited

U.S. PATENT DOCUMENTS

| | | | |
|---|---|---|---|
| 2,953,970 | 9/1960 | Maynard | 359/892 X |
| 3,758,200 | 9/1973 | Saito | 359/892 |
| 3,994,008 | 11/1976 | Land et al. | 359/892 X |
| 4,037,097 | 7/1977 | Stillman et al. | 359/892 X |
| 4,416,528 | 11/1983 | Breslau et al. | 359/892 X |
| 4,823,245 | 4/1989 | Leverte | 362/294 |
| 4,875,766 | 10/1989 | Shimodaira et al. | 359/893 |

FOREIGN PATENT DOCUMENTS

| | | | |
|---|---|---|---|
| 862733 | 3/1961 | United Kingdom | 359/892 |

*Primary Examiner*—Ira S. Lazarus
*Assistant Examiner*—Thomas M. Sember

[57] ABSTRACT

A color medium structure for use with a stage spotlight comprises a frame constituted by two opposite frame plates, preferably made of a fiber reinforced plastic, with a portion of the periphery thereof secured together to allow other portion of the periphery to be peelable off for receiving therebetween a light-transmitting color film. The light-transmitting color film is secured between the frame plates by the attraction of magnets mounted to the frame plates.

4 Claims, 2 Drawing Sheets

STAGE SPOTLIGHT COLOR MEDIUM STRUCTURE

FIELD OF THE INVENTION

The present invention relates to a stage spotlight and in particular to a color medium for use in the stage spotlight.

BACKGROUND OF THE INVENTION

In a stage, spotlights are widely used to produce "spot lighting" on a special scene. In general, the spotlight is provided with a number of color mediums in the form of different colored films to project out light beams of different colors. Conventionally, light-transmitting color films which are fixed on rigid frames, such as metal frames, slidable along a rail structure disposed before the light source of the spotlight are used to produce the colored light beams.

The disadvantages of the conventional color medium structure may be summarized as follows:

(1) The conventional color film frame is usually in the form of rectangle comprising sharp corners which are very dangerous to both human being and flats.

(2) The metal frame is quite heavy and if it falls down during movement, it may cause damage to either human being or devices.

(3) Due to the heavy weight of the metal frame, it is required to be stored separately from the color mediums; this generally results in a difficulty in seeking for the required color mediums in next operation.

It is therefore desirable to provide a color medium structure which comprises a light weight frame in which a light-transmitting color film is disposed to overcome the above-mentioned problems.

SUMMARY OF THE INVENTION

It is therefore the principal object of the present invention to provide a color medium structure comprising a light weight frame in which a light-transmitting color film is disposed to facilitate the move and the storage of the color mediums of a stage spotlight.

It is also an object of the present to provide a color medium structure comprising a frame constituted by two opposite frame plates, preferably made of a fiber reinforced plastic (FRP), between which a light-transmitting color film is disposed and maintained therein by the attraction of magnetic means mounted on the frame plates.

To achieve the above objects, there is provided a color medium structure for use with a stage spotlight comprising a frame constituted by two opposite frame plates, preferably made of a fiber reinforced plastic, with a portion of the periphery thereof secured together to allow other portion of the periphery to be peelable off for receiving therebetween a light-transmitting color film. The light-transmitting color film is secured between the frame plates by the attraction of magnets mounted to the frame plates.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 1:
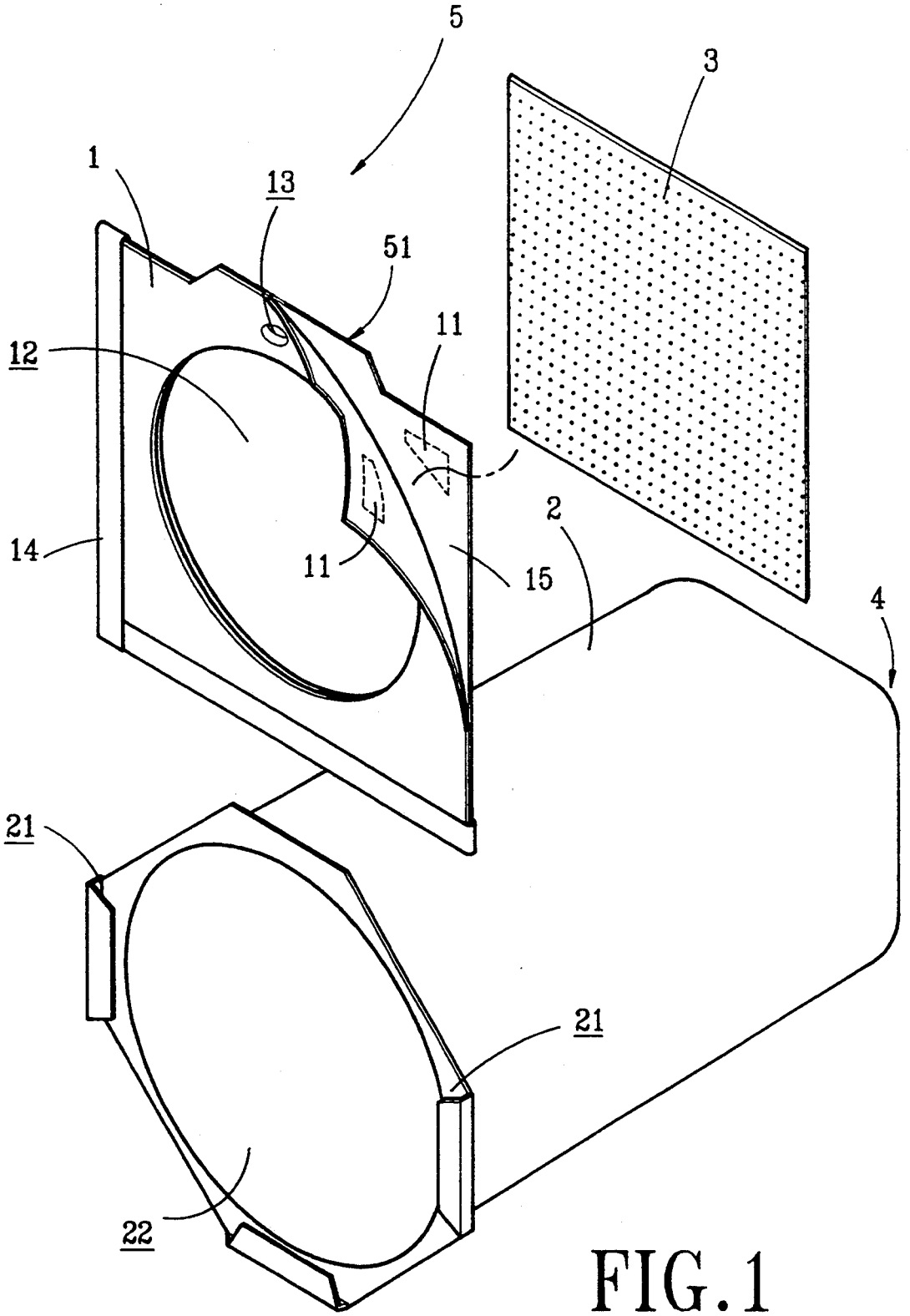
FIG. 1 is a perspective view showing a stage spotlight with a color medium constructed in accordance with the present invention detached therefrom to show the relationship therebetween.

With reference to the drawings and in particular to FIG. 1, wherein a stage spotlight, generally designated by the reference numeral 4, is shown, the spotlight 4 comprises a light body 2 which has a front opening 22 to allow a light beam to project out thereof. On the front opening 22 of the light body 2, guiding rail means 21 is provided to insertedly receive therein a color medium, generally designated by the reference numeral 5 in FIG. 1. The guiding rail means 21 may comprise a number of slots to receive and support therein the color medium 5, as shown in FIG. 1.

Figure 2:
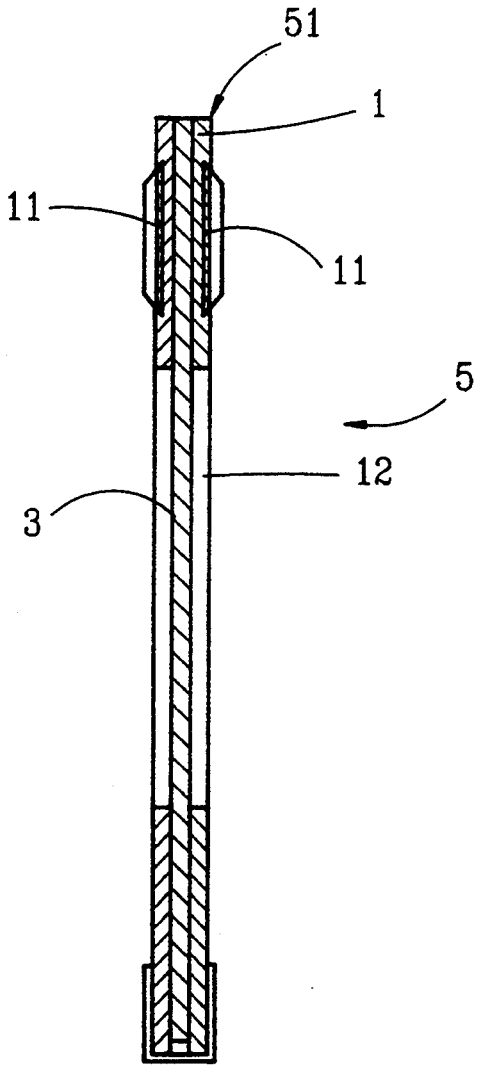
FIG. 2 is a cross-sectional view showing the structure of the color medium of the present invention.

Further referring to FIG. 2, the color medium 5 comprises a plate-like frame 51 constituted by two opposite, substantially flexible, light-weighted frame plates 1, each of which has a central hole 12 formed thereon for the transmission of the light beam projected out of the front opening 22 of the light body 2. Preferably, the frame plates 1 are made of a fiber reinforced plastic to reduce the weight thereof while maintaining the strength thereof.

The two opposite frame plates 1 are secured together along a portion 14 of the periphery thereof, for example, by adherence, to allow the frame plates 1 to be partially separable from each other along the other portion 15 of the periphery thereof. With the partial separation of the frame plates 1 from each other, a light-transmitting color film 3 having a size substantially large enough to cover the central holes 12 of the frame plates 1 is admitted to insert into inbetween the frame plates 1 to cover the central holes 12.

Securing means is provided to secure the separable portion of the frame plates 1 together so as to maintain the light-transmitting color film 3 between the two opposite frame plates 1. Preferably, the securing means comprises magnetic means 11 mounted to the separable portion of each of the frame plates 1 so as to have them releasably fix together by the attraction of the magnetic means 11.

Preferably, a through hole 13 is provided on the frame 51 to allow the color medium 5 to hang on a hanger (not shown), when not in use.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed is:

1. A color medium for a stage spotlight system comprising:

a frame comprising two opposing frame elements, each made of a lightweight, flexible material, the frame elements being permanently secured to each other only along a portion of a periphery of said frame elements such that said frame elements separate from each other to allow the insertion of a light-transmitting color medium therebetween, the medium being inserted through a portion of the periphery of the frame in which the two frame elements are not permanently secured to each other, the frame elements including releasable securing means for releasably securing the portion of the periphery of the frame in which the two frame elements are not permanently secured to each other, said light-transmitting color medium being a color film large enough to cover a central hole in each of the frame elements, the central hole being provided to allow a light beam to pass therethrough, and thus pass through the color film, thereby creating a spotlight which is the color of the film.

2. The medium as claimed in claim 1 wherein:

said frame elements are comprised of fiber reinforced plastics.

3. The medium as claimed in claim 1 wherein:

said releasable securing means comprise magnetic means mounted to the portions of the frame elements not permanently secured to each other.

4. The medium as claimed in claim 1 wherein:

said frame includes a through hole therein to facilitate hanging the medium on a hanger.

* * * * *